United States Patent [19]

Claassen, Jr.

[11] 4,293,319

[45] Oct. 6, 1981

[54] ELECTROSTATIC PRECIPITATOR APPARATUS USING LIQUID COLLECTION ELECTRODES

[75] Inventor: Ben J. Claassen, Jr., New Orleans, La.

[73] Assignee: The United States of America as represented by the Secretary of Agriculture, Washington, D.C.

[21] Appl. No.: 837,488

[22] Filed: Sep. 28, 1977

[51] Int. Cl.[3] ..... B03C 3/53

[52] U.S. Cl. ..... 55/122; 55/137; 55/138; 55/154

[58] Field of Search ..... 55/107, 108, 117–119, 55/122, 137, 138, 154, 240; 261/112

[56] References Cited

U.S. PATENT DOCUMENTS

| | | | |
|---|---|---|---|
| 1,377,363 | 5/1921 | Moon | 55/118 X |
| 1,828,631 | 10/1931 | Whitney | 55/118 X |
| 2,203,592 | 6/1940 | Brundage | 261/112 |
| 2,864,458 | 12/1958 | De Graaf et al. | 55/107 |
| 3,053,029 | 9/1962 | De Seversky | 55/118 |
| 3,440,799 | 4/1969 | Romell | 55/107 |
| 3,744,217 | 7/1973 | Ebert | 55/138 X |

FOREIGN PATENT DOCUMENTS

| | | | |
|---|---|---|---|
| 1188560 | 3/1965 | Fed. Rep. of Germany | 55/240 |
| 825140 | 12/1959 | United Kingdom | 55/154 |

*Primary Examiner*—Kathleen J. Prunner
*Attorney, Agent, or Firm*—M. Howard Silverstein; David G. McConnell; Raymond C. Von Bodungen

[57] ABSTRACT

An electrostatic precipitator which collects dust directly into electrodes consisting entirely of a liquid is disclosed. Fine wires discharge a corona current which flows to a continuous free falling liquid at ground potential. When dust laden air flows between the wires and the liquid electrodes, the dust particles are charged and deflected into the liquid thereby eliminating the need for mechanical cleaning or liquid washing of the electrodes.

5 Claims, 6 Drawing Figures

ELECTROSTATIC PRECIPITATOR APPARATUS USING LIQUID COLLECTION ELECTRODES

BACKGROUND OF THE INVENTION

1. Field of the Invention

This invention relates to the removal of dust from air. More specifically, dust is removed from air by means of an electrostatic precipitator apparatus.

2. Description of the Prior Art

Prior single-stage and two-stage electrostatic dust collectors operate on well established principles wherein dust is passed through an ionized region, a corona, and thereby charged and then collected due to forces applied to the charged particles by the corona field and any other static electric fields through which the particles are passed. In most precipitators dust deposits on rigid surfaces such as collection plates or casing walls as a dry cake and is subsequently removed by periodic rapping to cause the cake to drop into collection bins. The collected cake can reduce corona current, cause arcing, or cause a reverse current discharge from the dust, called back corona. These phenomena reduce collection efficiency. Additional efficiency loss occurs when dry dust is reentrained into the flowing gas during rapping. Finally, dry dust of a combustible nature, such as cotton dust, is a fire hazard when accumulated in an area where electrical arcing occurs.

To combat some problems of dry electrostatic precipitation wet electrode systems have been developed in several forms. The operation principle is the same as that for single- and two-stage precipitators with dry collection except that additional devices are provided to wet or rinse the dust collection surfaces and thereby eliminate removal by rapping. Such wetting devices may be continuous or intermittent liquid spray jets near collection surfaces, mechanically traversing liquid jet cleaners, or flow ports to provide a film coating over the dust collection surface. These devices add complexity to electrostatic precipitators and often inadequately wet collection surfaces thereby allowing dust or dust residues to accumulate in the precipitator. The maintenance of a continuous flowing uniform liquid film over all collection surfaces is essentially unattainable under field conditions with existing surface wetting and rinsing devices. The inadequacy of present wet-wall precipitators is evidenced by their limited share of the present commercial market as compared to dry precipitators with rappers.

DEFINITIONS OF TERMS USED

A liquid electrode is an electrode consisting essentially of a column of free falling liquid in laminar flow held at ground potential; and the liquid essentially is out of contact with solid members or surfaces during free fall movement.

A field electrode is a surface held at high voltage to establish a field while not emitting a corona current.

A single-stage electrostatic precipitator is an assembly of high voltage discharge electrodes and grounded electrodes which charge particles and deposit them on the grounded electrodes.

A two-stage electrostatic precipitator is an assembly of electrodes which charge particles as in the single-stage precipitator followed by a second set of electrodes which create a static electric field to deposit particles.

A one and a half-stage precipitator refers to an electrode configuration where the ground electrodes receive corona current as in a single-stage precipitator and these same ground electrodes interact with field electrodes to establish a collection field as used in a two-stage precipitator.

SUMMARY AND OBJECTS OF THE INVENTION

The instant invention comprises a duct or casing with exhaust gas flowing through an array of fine high voltage charging wires interspersed in an array of grounded columns of liquid (liquid electrodes) falling through a gravity field. A high voltage DC electrical source is connected to the fine wires and creates a corona discharge to the grounded liquid electrodes. In a charging and collection configuration, an array of high voltage surfaces of the same polarity as the fine wires may be interspersed within the duct.

The instant invention may be adapted to the many uses of present single and two-stage precipitators. It has been applied to removing micron size cotton dust from the circulated environmental air of a laboratory cotton textile mill. It could also be adapted to removing dust from exhaust gases, combustion products of coal or petroleum, process dust in manufacturing plants, or any other particle laden gas.

The principal object of the invention is to remove dust or particles from gas or air.

Another object of the instant invention is to eliminate adverse corona phenomena associated with dry deposited dust and particles.

Another object of the invention is to remove dust and particles from process gas without the use of mechanical collection electrode cleaning devices.

Another object of the invention is to charge particles for subsequent downstream collection, manipulation, or conveying by other applied electric fields.

Another object of the invention is to collect dust and concentrate it in a liquid without dust reentrainment into the exhaust gas at any velocity.

Another object of the invention is to replace liquid coating devices and film flow devices as previously used on collection electrodes with an easily maintained flow system which assures no residue deposit and no unwetted collection surfaces.

Another object of the invention is to combine charging and collection of dust or particles in a one and a half-stage configuration and thus enhance deflection of dust toward liquid electrodes.

Another object of the invention is to eliminate the collection electrode surfaces used in prior electrostatic dust collectors.

Other objects and advantages of the invention will become obvious from the detailed description of the invention.

DESCRIPTION OF THE PREFERRED EMBODIMENTS

Figure 1:
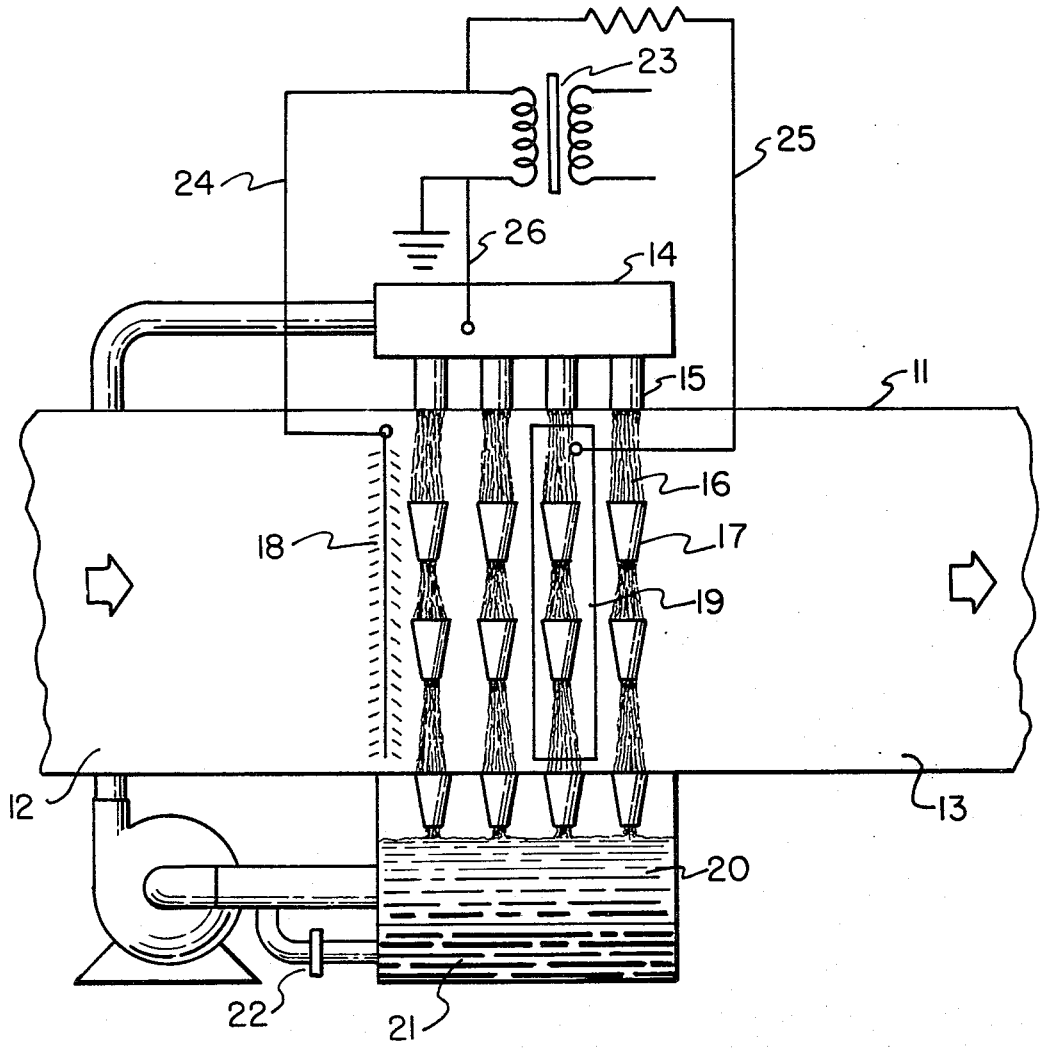
FIG. 1 is a schematic of a complete installation for exhaust gas cleaning.
Figure 2:
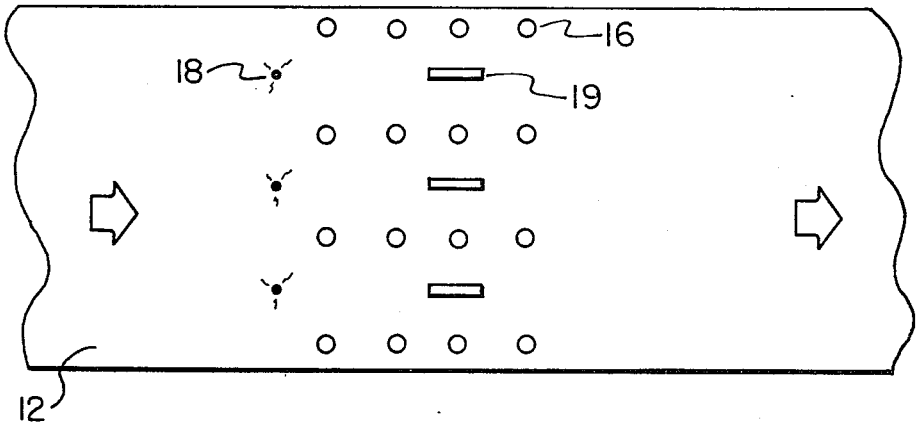
FIG. 2 is a plan view of one possible configuration of the charging and collection element.

FIGS. 1 and 2 represent an electrostatic precipitator with liquid collection electrodes. Corona discharge wires 18, liquid electrodes 16, and field electrodes 19 are arranged in a duct or casing 11.

FIG. 2 is representative of one of many arrangements of discharge wires 18, liquid electrodes 16, and field electrodes 19.

In operation, a continuous flow of gas containing particles enters through inlet 12, FIGS. 1 and 2. Gas passes through the corona which is established between corona wires 18 and nearby grounded liquid electrodes 16. Water has been used but any liquid with at least slight electrical conductivity could be used. Ion flow in the corona charges the particles in the gas. The charged particles are then deflected by the corona field and any applied static field as established by field electrode 19 and liquid electrode 16. (In the instant embodiment charged plates or screens act as a static field.) This deflection takes the form of a particle migration toward grounded liquid electrodes 16 while the gas continues through duct or casing 11 and exits clean through outlet 13.

With proper selection of electrode configuration and establishment of corona and static fields using proper electrode voltages, the particles down to 1 micron size will deflect sufficiently to intercept the liquid electrodes. (We have collected respirable cotton dust using +20 Kv on all high voltage surfaces in FIG. 2 type configuration). As liquid electrode 16 intercepts the dust particles they mix in the liquid and continue circulating until separated out of the system. Continuous operation is maintained by periodically filtering or settling out the particles from the liquid, as is done with a settling tank 21 or by passing the liquid through a parallel flow path which would include a filter 22.

Figure 4:
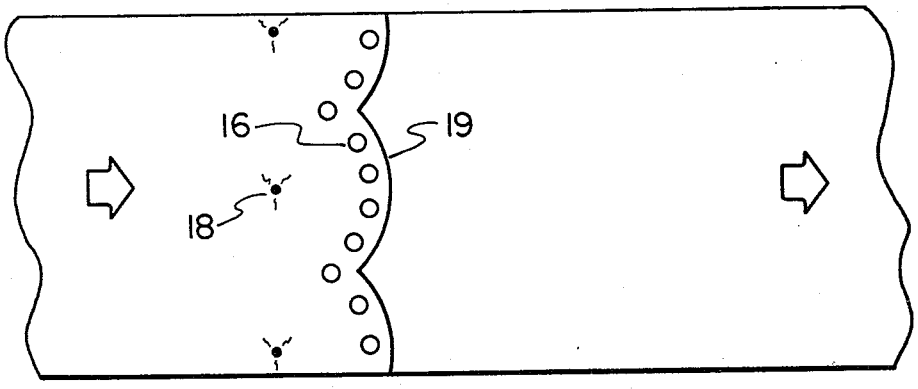
FIG. 4 is an alternate plan view of a possible configuration of the charging and collection element using a screen as the field electrode 19.

FIG. 4 represents another configuration of corona wires and liquid electrodes used to remove dust particles from gases. The curved arrangement of liquid electrodes 16 and the field electrode 19 is intended to form a pocket with electrodes at equal radial distance from the corona wires 18.

The configurations presented are for illustration only and not intended to limit the invention, and it is to be understood that many other configurations will work just as well.

In another embodiment of the invention when it is necessary to charge the dust particles and not collect them, as in a use for spray deposition or other processes requiring charged particles, the corona field imparts a charge to the dust particles and the static field is not used since no deflection is intended. Therefore, no other electrodes are used in conjunction with the corona field and grounded liquid electrodes. The electrode configuration is selected which will minimize deflection and interception of particles into liquid electrodes 16.

Figure 3:
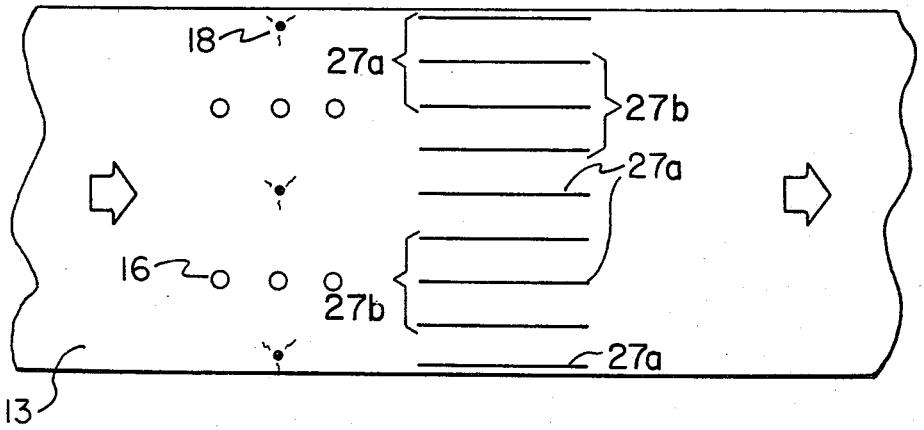
FIG. 3 is a plan view of a liquid electrode charging stage used upstream of a conventional second stage collection section.

An embodiment of the invention which consists of only corona wires 18 and liquid electrodes 16 as in FIG. 3 is used with proper electrode spacing to achieve partial collection of particles without the use of field electrodes. In this figure the particles are charged by corona wires 18 and a percentage of particles are collected in liquid electrodes 16, and a secondary static field forms a secondary collection of charged particles downstream from the corona field. Gases containing dust particles are subjected to the corona field set up by corona wires 18. The dust particles are charged and approximately 70% are deflected into liquid electrodes 16. A downstream secondary static field collection as created between charged surfaces **27*a* in near proximity to grounded surfaces 27*b* is then employed to remove the remaining dust particles, and clean gas is exited through 13**. This embodiment results in a higher percentage of collection of particles.

Figure 5:
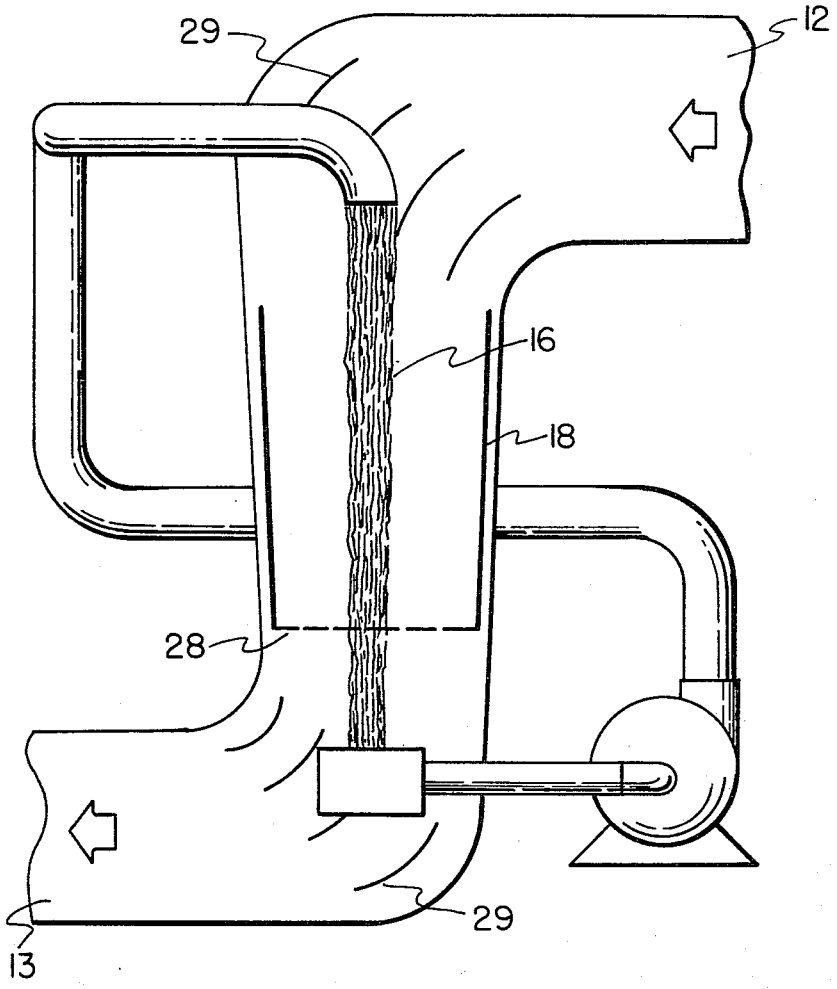
FIG. 5 is a side view of liquid electrodes for dust collection in an axial gas flow.

In another embodiment of the invention as shown in FIG. 5, a vertical gas flow system is employed. Charging and collection occur along the entire length of the corona wires 18 and the liquid electrodes 16 as the result of co-current contact between the downward directed gas stream and the free falling liquid stream. An optional gas distribution system 28 such as a perforated plate or straightening vanes is preferred for vertical operation. Particle laden gas enters at 12. Vertical corona wire 18 and grounded liquid electrode 16 establish a corona field. This corona field charges the particles in the gas and deflects said charged particles into grounded liquid electrode 16. Clean gas exits at 13. A gas distribution plate or vanes 28 and turning vanes 29 control the gas flow which is vertical. Countercurrent flow is also feasible wherein gas would enter the system at 13 and exit at 12.

Figure 6:
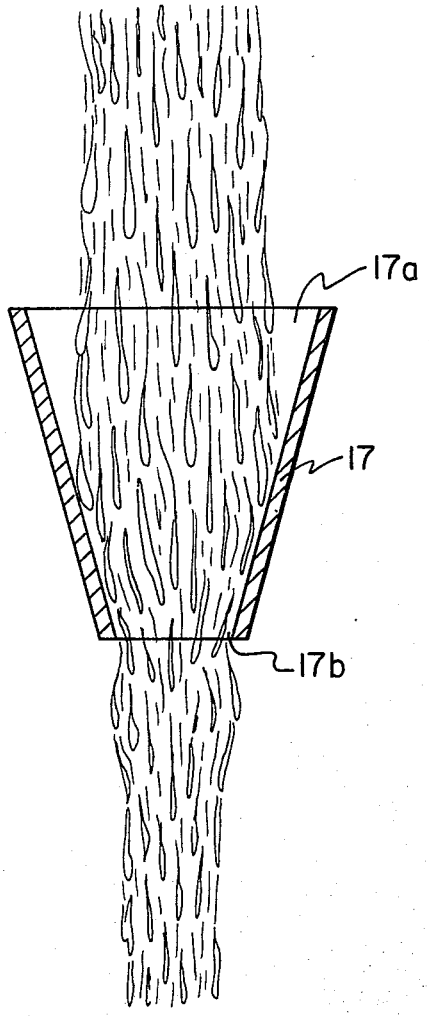
FIG. 6 is a view of one possible design of restart tube.

In each of the above cases, unit height of the liquid electrodes can be varied. This is accomplished as shown in FIGS. 1 and 6. Tubes 17 are placed between manifold 14 and collection reservoir 20 to reform the liquid electrode. When liquid is distributed by manifold 14 or any other type flow regulator, it flows through straightening tube 15 which produces a smooth, uniform flow in the liquid electrodes 16 which are grounded thus forming a grounded liquid electrode. Grounded liquid electrode 16 free falls into collection reservoir 20 beneath the array of electrodes 16, 18, and 19 and below the duct. When the free falling liquid has moved through such a height as to cause disturbed flow with signs of electrode break up, reforming tubes 17 are placed between straightening tube 15 and collection reservoir 20. Tubes 17 include an entrance **17*a* to capture the free falling liquid prior to its falling into the reservoir 20. By means of the downwardly tapered, ever-increasing flow restriction configuration of the tube, the free fall movement of the liquid is temporarily interrupted, and thereafter the liquid discharges through exit passage 17*b* in a smooth, uniform flow of liquid required in a liquid electrode. Additionally, the tube realigns the liquid electrode in a downward, straightened path relative to corona wires 18**. This arrangement can be followed for as many reformings as is required by the height being transversed. This process minimizes liquid deflection by drag forces and electric field forces and thus maintains electrode spacing.

In all the embodiments described above, the electric circuit required is a high voltage DC power supply 23 with electrical connections 24 suitable to attach to corona wires 18. A secondary voltage electrical connection 25 is attached to field electrodes 19 and a ground connection 26 is placed in the conductive liquid at the distribution manifold 14.

The intended scope of the present invention should not be limited to the specific embodiments selected for description. All configurations using the principles of the invention are considered as included in the claims unless the claims expressly state otherwise. All charging and collection devices using the method of dust collection directly into a liquid, which is free falling and not adhering to a solid surface or flowing over a surface as a coating, are included in the method of this invention.

I claim:

1. An apparatus for electrostatically imparting a charge to particles in particle-laden gas comprising:

(a) a duct for conveying said particle-laden gas;

(b) a high voltage electrode within said duct to create a corona discharge and thereby charge said particles;

(c) a grounded electrode within said duct adjacent said high voltage electrode; said grounded electrode consisting essentially of a column of free-falling liquid in laminar flow, said grounded electrode positioned within said duct in such a manner as to intercept and remove charged particles from said gas; and (d) a field electrode within said duct adjacent said high voltage electrode and said grounded electrode to deflect charged particles into said grounded electrode.

2. The apparatus of claim 1 further including a reservoir below said column of liquid to collect said liquid, and below said duct; a tube above said reservoir; wherein said tube includes an entrance to temporarily interrupt free-fall movement of said liquid column, and capture said liquid prior to its falling into said reservoir, and an exit passage to direct a smooth, uniform flow of captured liquid in a downward, straightened path toward said reservoir.

3. The apparatus of claim 2 further including means connected to said reservoir to separate particles from said liquid collected in said reservoir which have been removed from said gas by said liquid.

4. The apparatus of claim 2 further including means connected to said reservoir to separate particles from said liquid which have been removed from said gas by said liquid.

5. The apparatus of claim 4 further including means to pass said gas in co-current contact with said free-falling liquid.

* * * * *